United States Patent [19]

Hillquist

[11] Patent Number: 4,554,682

[45] Date of Patent: Nov. 26, 1985

[54] CONVERTIBLE JACKET

[76] Inventor: Paul A. Hillquist, R.D. 2, Box 2760, Bryant Pond, Me. 04219

[21] Appl. No.: 597,045

[22] Filed: Apr. 5, 1984

[51] Int. Cl.[4] ..... A41B 1/12; A41D 1/04

[52] U.S. Cl. ..... 2/70; 2/102; 2/108

[58] Field of Search ..... 2/102, 108, 70, 95, 2/84, 85, 86, 91, 126

[56] References Cited

U.S. PATENT DOCUMENTS

| | | | |
|---|---|---|---|
| 1,250,836 | 12/1917 | Fowler | 2/109 |
| 4,149,272 | 4/1979 | Maeshima | 2/102 |
| 4,320,538 | 3/1982 | Saft | 2/102 |
| 4,470,155 | 9/1984 | Maeshima | 2/102 |

*Primary Examiner*—Doris L. Troutman

[57] ABSTRACT

A convertible jacket comprising a sleeveless body garment in the general form of a vest and an upper component comprising, as a unit, two sleeve portions connected by a yoke portion incorporating a neckhole and, optionally, a neckhole extension such as a collar or hood. The yoke portion of the upper component is so configured as to substantially cover the upper back and shoulder area of the body.

The upper component, when combined with the vest, forms a selectively convertible jacket providing a second layer of construction upon the upper back and shoulders, minimum restriction of arm and shoulder movement and positive body ventilation. The upper component can be readily oriented to and attached to the vest by fastener means and can be readily detached and removed from the vest. Such attachment or removal may be effected without regard to whether the vest is being worn.

4 Claims, 4 Drawing Figures

CONVERTIBLE JACKET

FIELD OF THE INVENTION

This invention relates to outergarments and particularly to convertible jackets intended for active or leasure wear in which a wide range of temperatures, weather conditions and wearer activities can be accommodated by such convertibility.

BACKGROUND AND PRIOR ART

Jackets or coats composed of two or more components detachable from each other to accommodate changing weather and temperature conditions and also to accommodate different levels of physical activity are well known and widely available. Prior art generally has involved inner and outer garments, such as a vest detachably fastened within a jacket shell or an insulative component also detachably fastened within an outergarment. Such convertible garments may be configured as two or more independently wearable components such as the vest within an outer jacket or may have additional layers or linings selectively attached to a basic garment. Another approach to convertibility has involved a garment from which traditional parts such as sleeves or hoods are separable.

Disadvantages of such existing constructions include excess weight and bulk caused by multiple layers of construction in areas not requiring maximum warmth, lack of multiple coverage in areas where maximum protection is desirable, the practical requirement to remove such garments from the wearer in order to readily attach or remove components and the concomitant problem of conveniently and comfortably carrying detached components when necessary or desirable.

Existing convertible jackets generally do not provide for adaquate body ventilation and unrestricted arm and shoulder movement when fully assembled. Ventilating panels of materials such as mesh preserve the unitary construction of garment areas to which they are joined and therefore do not contribute to freedom of arm and shoulder movement. Conversely, pleated or extensible panel constructions in convertible garments complicate orientation and attachment of the garment components.

SUMMARY OF THE INVENTION

This invention relates to a convertible outergarment or jacket in which a very wide range of temperatures, weather conditions and wearer activities can be accommodated by the selective exercise of such convertibility and which provides funtional and convenience characteristics not heretofore realized in such garments.

This invention discloses a sleeveless body garment in the general form of a vest and an upper component comprising, as a unit, two sleeve portions connected by a yoke portion incorporating a neckhole. In a preferred embodiment a neckhole extension such as a collar or hood is provided. The yoke portion of the upper component is so configured as to substantially cover the upper back and shoulder area of the body. The vest or the upper component or both have fastener means to removably secure both components together in the form illustrated in the drawings. The upper component, when combined with the vest, forms an outergarment in the general form of a jacket. Such additional or alternative pockets, fitments and details of construction as are illustrated in the drawings or are required by the particular intended use of the jacket may also be provided.

OBJECTS OF THE INVENTION

Accordingly, one object of this invention is to provide a novel construction wherein a vest can be selectively converted to a jacket by the addition of a supplementary upper component which provides sleeves, a second layer of construction upon selected upper body areas and, in a preferred embodiment, additional neck and head protection by means of a neckhole extension.

Another object of this invention is to provide a convertible jacket wherein the selective addition or removal of components can be readily and conveniently accomplished without regard to whether the jacket is being worn and without exposing or endangering the contents of any pockets or cargo carrying provisions.

Another object of this invention is to provide a convertible jacket wherein all detachable components are of such size and bulk as may be conveniently and comfortably stored and carried by means provided in or upon said jacket.

Another object of this invention is to provide, in a convertible jacket, positive underarm and body ventilation when sleeves are attached and, cooperatively, with sleeves attached, to provide unrestricted arm and shoulder movement, said movement acting simultaneously to regulate body ventilation.

Further objects and advantages of this invention will be apparent from the description and drawings.

DESCRIPTION OF THE INVENTION

Refering to the drawings in detail, in which like characters refer to like corresponding parts throughout the several views.

Figure 1:
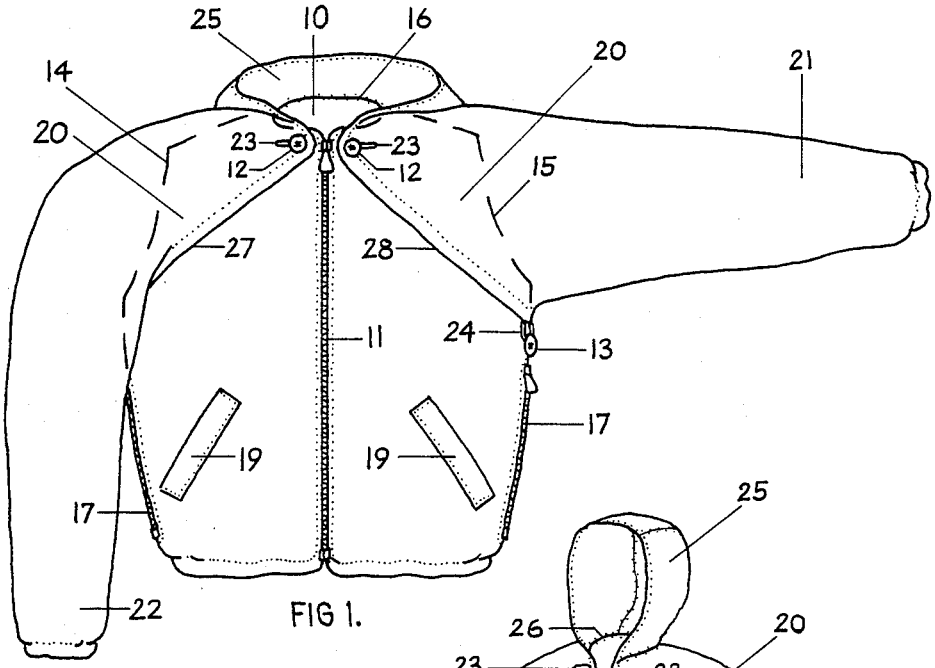
FIG. 1 is a plain front view of the assembled jacket.

A sleeveless body garment or vest is designated generally as 10. The vest 10 is shown with front vertical edges detachably secured by fastener means such as the zipper 11. The front edges of the neckhole 16 are provided with fastener means such as the buttons 12 and the lower edges of the armholes 14,15 are provided with fastener means such as the buttons 13. A large cargo pocket 18 across the inside of the back of the vest 10 is accessed by vertical openings under the buttons 13, said openings being secured by closure means such as the zippers 17. Additional pockets 19 are shown in this illustrated embodiment.

An upper component is designated collectivelly by the figures 20,21,22. The upper component is shown with two sleeve portions 21,22 and a yoke portion 20 incorporating a neckhole 26 and a hood 25 attached to the neckhole 26. The front edges of the neckhole 26 are provided with fastener means such as the buttonholes 23 and the lower edges of the armhole openings of the sleeve portions 21,22 are provided with fastener means such as the button loops 24.

The upper component is adapted to be attached to the vest 10 by orienting the yoke portion 20 over the shoulder surfaces of the vest 10 wherein the vest buttons 12 are coincident with the upper component buttonholes 23 and the vest buttons 13 are coincident with the upper component armhole loops 24. The vest neckhole 16 is substantially coincident with the yoke portion neckhole 26 and the hood 25 extends, in various positions, beyond the vest neckhole 16. The yoke portion 20 covers an area of the vest 10 shown in FIG. 1 by the hidden edges of the vest armholes 14,15 located by broadly broken lines, in relationship to the front edges 27,28 of the yoke portion 20 and also in FIG. 4 by the rear edge 29 of the yoke portion 20 in relationship to the back area of the vest 10.

Figure 2:
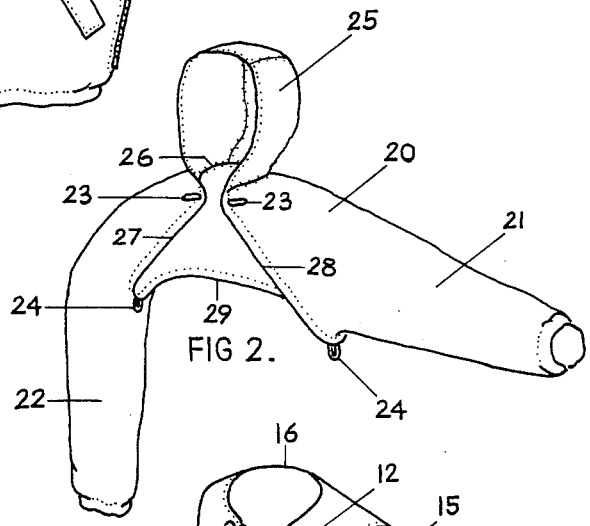
FIG. 2 is a perspective front view of the upper component of the jacket.
Figure 3:
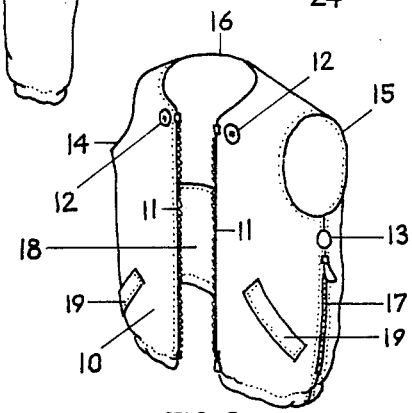
FIG. 3 is a perspective front view of the vest component of the jacket.
Figure 4:
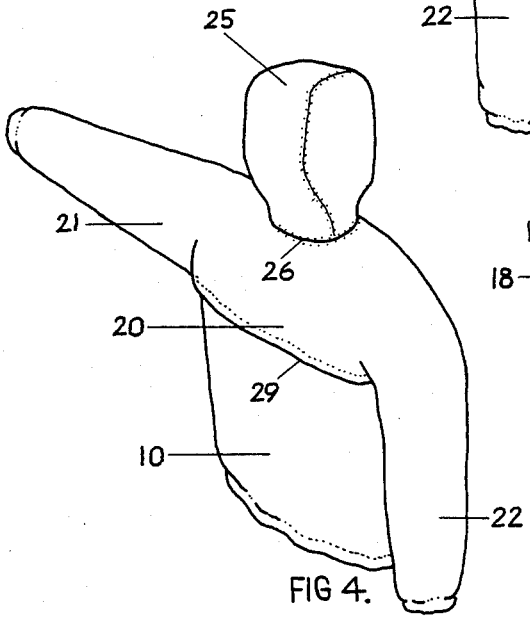
FIG. 4 is a perspective rear view of the assembled jacket.

In FIG. 1, FIG. 2, and FIG. 4 the upper component sleeve portion 21 is shown in a horizontally extended position and the sleeve portion 22 is shown in a vertical position wherein, in both instances, an overlap of construction is maintained between the yoke portion 20 at its edges 27,28,29 and the body of the vest 10, and also between the edges of the armholes of the sleeve portions 21,22 and the body of the vest 10. The vest 10 and the upper component 20,21,22 are constructed of cloth or other flexible material commonly employed for outerwear, which material together with the fastener means and the fastener locations shown in FIG. 1, FIG. 2 and FIG. 3 enable the upper component, during arm and shoulder movement, to move differentially relative to the vest 10, particularly along the yoke portion edges 27,28,29, thereby accommodating considerable arm and shoulder movement. Said differential movement along the yoke portion edges 27,28,29 also provides positive body ventilation simultaneously with and quantitatively related to arm and shoulder movement.

The closured openings 17 and the cargo pocket 18, in the vest 10, are so dimentioned and proportioned as to accept the upper component and to allow said upper component to be conveniently and comfortably carried in the pocket 18 while the vest is being worn.

While the description and drawings of this invention show a presently preferred embodiment, many variations are possible without departing from the essential qualities thereof. For example, the front of the yoke portion of the upper component could be extended to more fully cover the upper chest, additional pockets or pockets in other configurations or placements could be provided, other neckhole extensions could be substituted for the illustrated hood and many details of funtion or styling may be incorporated. Therefore, the scope of this invention should be determined from the appended claims.

I claim:

1. An upper component of an outergarment comprising, as a unit, two sleeve portions connected by a yoke portion incorporating a neckhole, said upper component being adapted to selective external attachment to a sleeveless body garment or vest and being so configured as to substantially cover body areas above the lower edge of the armholes of said vest, whereby said upper component is a means for selectively converting said vest to a jacket with multiple layers of construction substantially covering the upper back and shoulder area of the body.

2. The upper component of claim 1 including fastener means adjacent to the neck and lower side areas of said upper component externally for removably securing said upper component to a sleeveless body garment or vest.

3. An externally attachable upper component of an outergarment comprising, as a unit, two sleeve portions connected by a yoke portion incorporating a neckhole, and a sleeveless body garment or vest, whereby said upper component and said vest, in combination, form a selectively convertible jacket and wherein said upper component is so configured as to substantially cover body areas above the lower edges of the armholes of said vest.

4. The externally attachable upper component and the vest of claim 5 including corresponding fastener means adjacent to the neck and lower side areas of both said upper component and said vest.

* * * * *